US007114671B2

(12) United States Patent
David

(10) Patent No.: US 7,114,671 B2
(45) Date of Patent: Oct. 3, 2006

(54) DEVICE FOR SEPARATING THE HARD COMPONENTS OF A GRINDER USED IN THE FIELD OF THE FOOD INDUSTRY, AND IN PARTICULAR FOR THE MINCING OF MEAT

(75) Inventor: Guy David, Amberieu en Bugey (FR)

(73) Assignee: ETS David Guy, Ambronay (FR)

( * ) Notice: Subject to any disclaimer, the term of this patent is extended or adjusted under 35 U.S.C. 154(b) by 210 days.

(21) Appl. No.: 10/777,497

(22) Filed: Feb. 12, 2004

(65) Prior Publication Data

US 2004/0173700 A1 Sep. 9, 2004

(30) Foreign Application Priority Data

Feb. 25, 2003 (FR) ..... 03 02286

(51) Int. Cl.
*B02C 18/36* (2006.01)
*B02C 18/30* (2006.01)

(52) U.S. Cl. ..... 241/82.5; 241/82.1; 241/82.2; 241/82.3; 241/82.4; 241/82.6; 425/382 R; 425/464; 426/513; 426/516; 426/646

(58) Field of Classification Search ..... 241/82.1–82.5, 241/82.6, 82.7; 425/382 R, 464; 426/513, 426/516, 646
See application file for complete search history.

(56) References Cited

U.S. PATENT DOCUMENTS 4,202,502 A 5/1980 Laska
4,358,061 A * 11/1982 Richter ..... 241/82.4
4,699,325 A 10/1987 Hess
4,795,104 A 1/1989 Rudibaugh
4,978,077 A * 12/1990 Huebner et al. ..... 241/30
5,405,095 A * 4/1995 Lesar ..... 241/82.5
5,417,376 A 5/1995 Holmes et al.
5,443,214 A * 8/1995 Lesar ..... 241/82.2

FOREIGN PATENT DOCUMENTS

FR 2474342 7/1981

* cited by examiner

*Primary Examiner*—Derris H. Banks
*Assistant Examiner*—Jason Y. Pahng
(74) *Attorney, Agent, or Firm*—Egbert Law Offices

(57) ABSTRACT

A device for separating the hard components for a grinder used in the field of the food industry, and more particularly of the mincing of meat, downstream of one or several cutting assemblies, includes a grid for stopping hard components which is associated with a separating cutter of for draining hard components towards the center, in order to cause them to pass into a collecting tube which is screwed into a supporting grid or spider according to an adjustable depth.

The collecting tube includes, an axial recess capable of receiving the end of a driving shaft of the cutters of the grinder, so that the latter can be held transversely and rotate in it and, peripherally with respect to the axial recess, at least one channel allowing the transit of hard components.

5 Claims, 1 Drawing Sheet

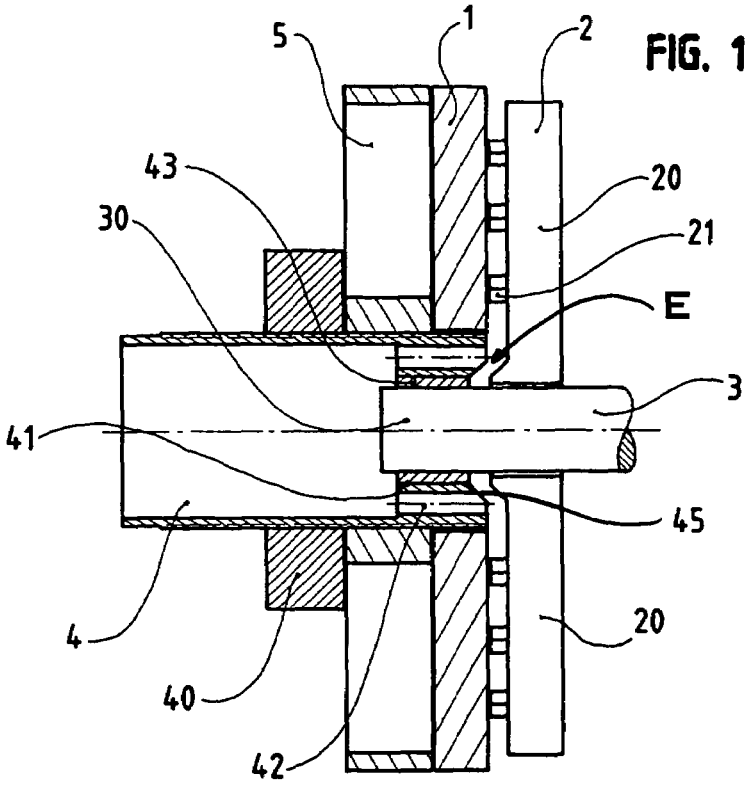
FIG. 1
FIG. 2
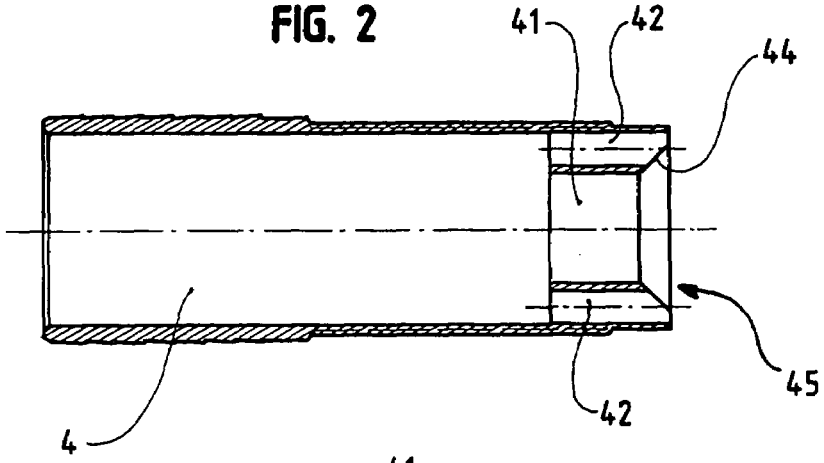
FIG. 3
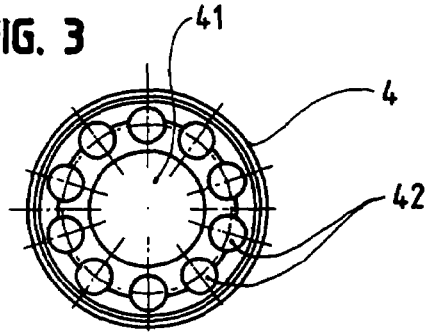

DEVICE FOR SEPARATING THE HARD COMPONENTS OF A GRINDER USED IN THE FIELD OF THE FOOD INDUSTRY, AND IN PARTICULAR FOR THE MINCING OF MEAT

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to a device for separating the hard components for a grinder used in the field of the food industry, and more particularly of the mincing of meat.

BACKGROUND OF THE INVENTION

In the field of the industrial mincing of meat, grinders are used that each essentially comprise a feed hopper ending into a room in which acts an endless screw which pushes the meat towards one or more cutting assemblies, each comprised of a star-shaped cutter with several legs, whether curved or not, and a grid having more or less large openings. For each of the cutting assemblies, the cutter can freely rotate on the grid and, eventually, within the two grids surrounding it, when such is the case, said grid or grids being capable of being immobilized within the grinder, while a shaft is capable of rotationally driving the cutters through which it passes, by being connected to the latter in rotation through at least one flat surface, while one of its ends is connected to driving means and the other end rotates in the bearing block of a supporting grid or spider.

Furthermore, devices are known which allow to sort the meat, i.e. to separate from the hard components, which are essentially the cartilages, the tendons and the nerves. These separating devices are intended at being optionally arranged at the outlet of the grinder.

The most effective one of these devices consists of a grid associated with a separating cutter which is also star-shaped with several legs, whether curved or not, each one including, on one surface, parallel ribs forming an angle with the radial axis of the leg. The ribs are intended at coming into contact with the grid, in order to scrape the latter and, because of their orientation, to drain towards the center the hard components which do not pass through the grid. The hard components pass between the separating cutter and the grid to arrive into the central hole of the latter, between the latter and the driving shaft, said central hole having, to this end, a diameter much larger than that of said shaft. According to a variant, a collecting tube is screwed into the supporting plate and is inserted into the central hole of the grid at an adjustable depth, with a possibility of blocking, in order to adapt its position with respect to the separating cutter. The collecting tube is, furthermore, connected to a discharge pipe for the hard components.

Such a device has however many disadvantages, in addition to dysfunctions and a sometimes poor result, fast wear of the cutters and grids is observed.

Indeed, when a separating device is fitted on the grinder, the separating cutter is not designed so as to rotate in the grid in order to allow the passing through of the hard components, which eliminates means for holding said cutter, while the end of the driving shaft is no longer held, because of the replacement of the bearing block by the collecting tube. Therefore, the transversal hold of the end of the shaft is not ensured, which results, because of the many constraints which the separating cutter is subjected to and which are increased when the meat is frozen, into movements of the separating cutter with respect to the grid, which generate a premature wear of the latter.

In order to cope with this disadvantage, there has been proposed, in addition to holding the end of the shaft from the outside, as in U.S. Pat. No. 5,417,376 and U.S. Pat. No. 5,443,214, to replace the grid and the collecting tube of the separating device by a grid provided, externally, with an end adapter for coupling a discharge pipe for the hard components, and which is perforated with holes distributed over the periphery of the seat in which the end of the driving shaft rotates, in order to end into said coupling adapter. The end of the shaft is thus held and the hard components can pass through the grid and be evacuated into the discharge pipe. Such devices are provided in U.S. Pat. No. 4,97B,077, U.S. Pat. No. 4,699,325, U.S. Pat. No. 4,202,502 and U.S. Pat. No. 4,795,104, and they all have the same disadvantage, that of not allowing an easy adjustment of the selection of the size of the hard components to be evacuated.

In order to cope with this disadvantage, FR 2,474,342 provides a grid also perforated with holes over the periphery of the seat in which the end of the driving shaft rotates, while the collecting tube is held externally against said grid and has holes which, according to the angular orientation of said tube with respect to said grid, are likely to be more or less closed, in order to control the size of the hard components. This device has however another disadvantage, indeed, the adjustment of the selection of the size of the hard components occurs downstream of the grid, which gives rise to frequent clogging incidents and requires interventions.

BRIEF SUMMARY OF THE INVENTION

The object of the present invention is to provide a device for separating the hard components for a grinder allowing to cope with the various above-mentioned disadvantages.

The device for separating the hard components for a grinder according to the invention is of the type comprising, downstream of one or several cutting assemblies each comprised of a star-shaped cutter with several legs and a grid having more or less large openings, a grid for stopping said hard components which is associated with a separating cutter designed capable of draining said hard components towards the center, in order to cause them to pass between said cutter and said grid into a collecting tube intended at being connected to a discharge pipe, said collecting tube being screwed into a supporting grid or spider according to an adjustable depth with a possibility of blocking, through a counter-nut, in order to adapt its position with respect to said separating cutter, and it is mainly characterized in that said collecting tube includes, on the one hand, an axial recess capable of receiving the end of the driving shaft of the cutters of said grinder, so that the latter can be held transversely and rotate in it and, on the other hand, peripherally with respect to said axial recess, at least one channel capable of allowing the transit of said hard components towards said discharge pipe.

Thus the end of the driving shaft is held and can rotate in the collecting tube, while the hard components can escape through the opening or openings which edge the axial recess of said collecting tube, which allows, through the possibility of adjusting its depth, i.e. of adapting the distance which separates its end from the cutter, to control the size of said hard components.

According to an additional feature of the device according to the invention, the axial recess of the collecting tube intended at receiving the end of the driving shaft is provided with a ring.

The driving shaft has often a cross-section other than round, in order to allow the engagement with the cutters. Most often, it has one or more flat surfaces, and the ring has a shape suitable for allowing the end of the shaft to rotate without any backlash in the recess of the collecting tube.

According to a preferred embodiment of the device according to the invention, the collecting tube has an axial channel surrounded by a plurality of peripheral channels with axes parallel to said axial channel.

According to an additional feature of the preferred embodiment of the device according to the invention, the axial channel and the peripheral channels extend in the collecting tube over a portion of the latter.

According to another additional feature of the preferred embodiment of the device according to the invention, the ends of the peripheral channels on the side of the cutter are beveled.

The advantages and features of the device according to the invention will become clear from the following description which refers to the attached drawing, which represents a non-restrictive embodiment of it.

BRIEF DESCRIPTION OF THE SEVERAL VIEWS OF THE DRAWINGS

FIG. 1 shows a partial, schematic, longitudinal cross-sectional view of a device for separating the hard components for a grinder according to the invention.

FIG. 2 shows a longitudinal cross-sectional view of part of the same separating device.

FIG. 3 shows a front elevation view of the same part showen in FIG. 2.

DETAILED DESCRIPTION OF THE INVENTION

Referring to FIG. 1, one can see that a device for separating the hard components for a grinder according to the invention comprises a grid 1 intended at stopping the hard components, associated with a separating cutter 2 driven in rotation by a driving shaft 3 having at least a flat surface. The separating cutter 2 comprises, in a known way, legs 20 provided, each, on one surface with ribs 21 forming an angle with the radial axis of the leg 20 which carries them, so as to scrape the surface of the grid and to bring back towards the center the hard components which do not pass through the grid 1.

The hard components are evacuated, also in a known way, at the center of the grid 1 through which passes a collecting tube 4 screwed into a supporting grid or spider 5 and blocked on the latter through a counter-nut 40.

According to the invention, as can also be seen in FIGS. 2 and 3, the collecting tube 4 includes, at the level of its end, in front of the separating cutter 2, over a length substantially corresponding to that of the free end 30 of the driving shaft 3, a cylindrical axial recess 41, edged, on the periphery, by channels 42 parallel to the axis of the tube 4.

The recess 41 is intended at receiving the free end 30 of the driving shaft 3, through a ring 32. Thus, the free end 30 of the shaft 3 provided with its ring 43 can freely rotate in the recess 41, while being held, nevertheless without preventing the evacuation of the hard components, which pass through the peripheral channels 42, in order to spread within the tube 4 before being evacuated into a flexible hose, not shown, capable of being connected to the other end of tube 4.

The separating cutter 2 remains into contact with the grid 1, which is held by the spider 5. The possibility of moving the collecting tube 4 with respect to spider 5 allows to change the space E which separates the cutter 2 from the end 45 of the collecting tube 4, changing this space E allowing the adjustment of the selection of the size of the hard components to be evacuated. Since this adjustment occurs upstream of the collecting tube, there is no problem of clogging, as is the case with the above-mentioned devices.

It should be noted, furthermore, that the ends of the peripheral channels 42 on the side of the end 45 are beveled, so as to create wider openings 44 which facilitate the evacuation of the hard components.

Furthermore, the peripheral channels 42 of the embodiment shown have a round cross-section, but they may very well have a different cross-section.

I claim:

1. An apparatus for separating hard components from a grinder comprising:

a grid means having openings formed therein, said grid means for stopping the hard components and for draining the hard components toward a center thereof;

a separating cutter having a generally star-shape with legs extending from a center thereof, said separating cutter having a drive shaft connected thereto; and a collecting tube positioned centrally of said grid means, said grid means comprising a supporting grid, said grid means for causing the hard components to pass between said supporting grid and said separating cutter and into said collecting tube, said supporting grid being connected by a counter-nut to said collecting tube such that a relative rotation of said counter-nut between said supporting grid and said collecting tube causes change of distance between said separating cutter and supporting grid, said collecting tube having an axial recess receiving an end of said drive shaft therein, said end of said drive shaft being freely rotatable within said axial recess, said collecting tube having at least one channel formed in a periphery of said collecting tube, said collecting tube suitable for connection to a discharge pipe, the channel suitable for transmitting the hard components toward the discharge pipe.

2. The apparatus of claim 1, further comprising:

a ring received within said axial recess, said end of said drive shaft received in said ring.

3. The apparatus of claim 1, said at least one channel comprising a plurality of peripheral channels each having a longitudinal axis parallel to a longitudinal axis of said axial recess.

4. The apparatus of claim 3, said axial recess and said plurality of peripheral channels extending along only a portion of said collecting tube.

5. The apparatus of claim 1, said plurality of peripheral channels each having a beveled end.

* * * * *